US006747412B2

(12) United States Patent
Vancil

(10) Patent No.: US 6,747,412 B2
(45) Date of Patent: Jun. 8, 2004

(54) TRAVELING WAVE TUBE AND METHOD OF MANUFACTURE

(76) Inventor: Bernard K. Vancil, 21070 SW. Tile Flat Rd., Beaverton, OR (US) 97007-8739

( * ) Notice: Subject to any disclaimer, the term of this patent is extended or adjusted under 35 U.S.C. 154(b) by 0 days.

(21) Appl. No.: 10/125,774

(22) Filed: Apr. 17, 2002

(65) Prior Publication Data

US 2002/0167276 A1 Nov. 14, 2002

Related U.S. Application Data

(60) Provisional application No. 60/290,505, filed on May 11, 2001.

(51) Int. Cl.[7] ..... H01J 25/34

(52) U.S. Cl. ..... 315/3.5; 315/39.3

(58) Field of Search ..... 315/3.5, 3.6, 39.3, 315/3, 5, 5.12, 5.38, 5.39; 313/346 DC; H01J 25/34

(56) References Cited

U.S. PATENT DOCUMENTS

| | | | | | |
|---|---|---|---|---|---|
| 3,715,616 | A | * | 2/1973 | Elfe | 315/3.5 |
| 3,716,745 | A | * | 2/1973 | Phillips | 315/3.6 |
| 3,971,965 | A | | 7/1976 | Baker et al. | 315/3.5 |
| 3,971,966 | A | | 7/1976 | Gottfried et al. | 315/39.3 |
| 4,057,749 | A | | 11/1977 | Davis | 315/3.5 |
| 4,093,891 | A | | 6/1978 | Christie et al. | 315/3 |
| 4,093,892 | A | * | 6/1978 | Vanderplaats | 315/3.5 |
| 4,358,704 | A | * | 11/1982 | Conquest | 315/3.5 |
| 4,422,012 | A | * | 12/1983 | Kosmahl | 315/3.5 |
| 4,507,586 | A | | 3/1985 | Correll | 315/3 |
| 4,558,256 | A | * | 12/1985 | Karp | 315/3.5 |
| 4,586,009 | A | * | 4/1986 | James | 333/156 |
| 4,812,707 | A | | 3/1989 | Correll | 313/43.5 |
| 4,820,688 | A | | 4/1989 | Jasper, Jr. | 505/855 |
| 4,890,036 | A | * | 12/1989 | Kosmahl | 315/3.5 |
| 4,942,336 | A | | 7/1990 | Amboss et al. | 315/3.5 |
| 5,402,032 | A | * | 3/1995 | Allen et al. | 315/3.5 |
| 5,436,524 | A | | 7/1995 | Hagen et al. | 315/3 |
| 5,754,006 | A | * | 5/1998 | Tonegawa | 315/3.5 |
| 5,959,406 | A | * | 9/1999 | Hart et al. | 315/3.5 |
| 6,094,009 | A | | 7/2000 | Goebel | 315/3.5 |
| 6,127,769 | A | * | 10/2000 | Kadota et al. | 310/313 B |

OTHER PUBLICATIONS

Phillips, R.M., "High Power Ring–Loop Traveling–Wave Tubes for Advanced Radar", Microwave Systems News, Feb./Mar. 1975, pp. 47–49.

(List continued on next page.)

*Primary Examiner*—Don Wong
*Assistant Examiner*—Trinh Vo Dinh
(74) *Attorney, Agent, or Firm*—Dellett & Walters

(57) ABSTRACT

A traveling wave tube includes a glass or other insulating envelope having a plurality of substantially parallel glass rods supported therewithin which in turn support an electron gun, a collector and an intermediate slow wave structure. The slow wave structure itself provides electrostatic focussing of a central electron beam thereby eliminating the need for focussing magnetics and materially decreasing the cost of construction as well as enabling miniaturization. The slow wave structure advantageously includes cavities along the electron beam through which the r.f. energy is propagated, or a double, interleaved ring loop structure supported by dielectric fins within a ground plane cylinder disposed coaxially within the glass envelope.

30 Claims, 10 Drawing Sheets

OTHER PUBLICATIONS

Belohoubek, E. F., et al, "Design and Performance of an Electrostatically Focused 5–kw X–Band Traveling–Wave Tube", IEEE Transactions on Electron Devices, Mar. 1964, pp. 102–114.

Blattner, D.J. et al, "Medium–Power L– and S–Band Electrostatically Focused Traveling–Wave Tubes", RCA Review, Sep. 1959, pp. 426–441.

Blattner, D.J., et al, "Electrostatically Focused Traveling–Wave Tube", ELECTRONICS, Jan. 2, 1959, pp. 46–48.

Belohoubek, E.F., "Slow–Wave Structures for Electrostatically Focused High–Power Traveling–Wave Tubes", RCA Review, Sep. 1960, pp. 377–388.

Tien, Ping King, "Focusing of a Long Cylindrical Electron Stream by Means of Periodic Electrostatic Fields", Journal of Applied Physics, vol. 25, No. 10, Oct. 1954, pp. 1281–1288.

* cited by examiner

TRAVELING WAVE TUBE AND METHOD OF MANUFACTURE

This invention was made with Government support under contract NAS3-01003 awarded by NASA. The Government has certain rights in this invention.

BACKGROUND OF THE INVENTION

The present invention relates to traveling wave tubes and particularly to traveling wave tubes that can be economically manufactured to provide amplification at low to medium power levels.

Conventional traveling wave tubes utilize a slow wave structure through which an electron beam passes. In the tube, the electrons in the beam travel with velocities slightly greater than that of an r.f. wave, and on the average are slowed down by the field of the wave. A loss of kinetic energy of the electrons appears as increased energy conveyed to the field of the wave. The traveling wave tube may be employed as an amplifier or an oscillator.

Conventional traveling wave tubes employ periodic permanent magnets all along the electron beam to focus the electron beam. They also employ a ceramic-metal brazed construction with sometimes hundreds of ceramic and metal parts fitted and brazed together by skilled artisans. Consequently expense is very high. While this expense appears to be justified at high output power levels, at low output power the cost per watt renders the device economically unfeasible for many purposes. Thus, despite many advantages of the traveling wave tube (high bandwidth, high power, high frequency), it is sometimes replaced by solid state amplifiers at low power levels, say 5 to 100 watts.

In summary much of the expense is attributable to the ceramic-metal-brazed assembly technique and the use of dozens of periodic permanent magnets for focusing. If these were eliminated, tube cost would be dramatically reduced. It would appear that another form of focussing such as electrostatic focussing could be an alternative. However, attempts at providing electrostatic focussing in traveling wave tubes have not heretofore resulted in a practical device.

SUMMARY OF THE INVENTION

In accordance with the present invention, a substantially unitary structure comprising an electron gun, a collector and an intermediate slow wave structure is supported on a plurality of substantially parallel glass rods which are themselves disposed within an elongated cylindrical glass envelope. The electron gun and the collector may comprise a series of conductive wafers having pins embedded in the glass rods and apertures to pass the electron beam. Differing voltages are applied to alternate conducting members in the slow wave structure to provide focussing, while r.f. input and output means are located proximate the beginning and end of the slow wave structure for supplying the input r.f. energy and withdrawing the amplified output. The glass rodded structure is economically constructed and maintains excellent alignment for the passage of the electron beam.

In one embodiment, the slow wave structure comprises a ladder circuit within which r.f. energy is propagated back and forth across the electron beam.

In another embodiment, a plurality of r.f. cavities are disposed along the path of the electron beam.

In yet another embodiment, the slow wave circuit comprises a double helix supported by dielectric fins in turn provided with means for attaching the same to the glass rods.

In another embodiment, the slow wave structure comprises a double, interleaved ring loop structure supported by dielectric fins having means for attaching the same to envelope enclosed glass rods.

It is accordingly an object of the present invention to provide an improved traveling wave tube operable at relatively low power levels and providing substantial amplification.

It is another object of the present invention to provide an improved traveling wave tube of economical construction.

It is a further object of the present invention to provide an improved traveling wave tube utilizing electrostatic focussing but characterized by low beam losses in operation.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

Figure 1:
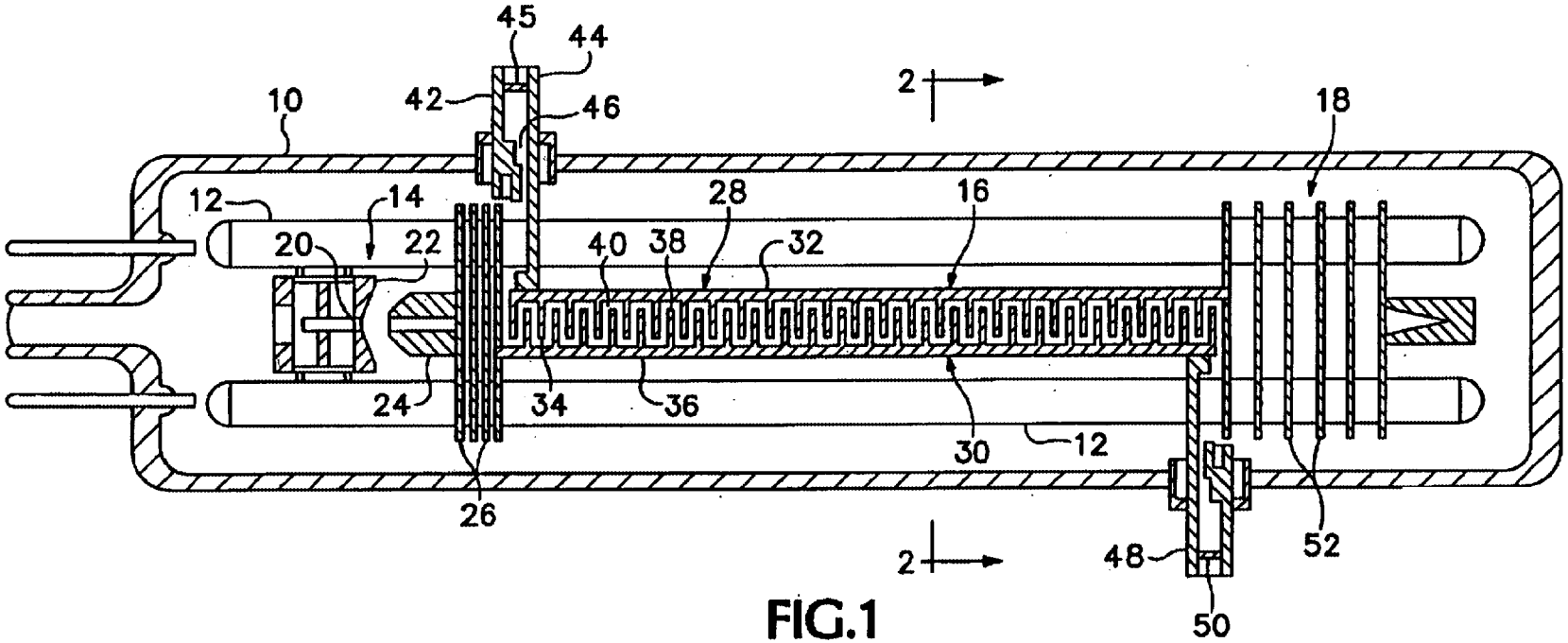
FIG. 1 is a longitudinal cross-sectional view of a first traveling wave tube according to the present invention employing a ladder circuit slow wave structure.

Referring to FIG. 1 illustrating a first embodiment of the present invention, a traveling wave tube comprises an elongated tubular glass envelope 10, cylindrical in shape and supporting therewithin a plurality of longitudinal glass rods 12. In this particular embodiment, there are four such rods running substantially the length of the glass envelope, parallel to the cylindrical axis of the envelope, in spaced relation within the walls of the envelope. The rods in turn support an electron gun 14, a slow wave structure 16 and a collector structure 18. The electron gun includes an axially central cathode 20 centered within the central aperture of a Pierce type focus electrode 22 and preferably just behind the lip of the aperture. Spaced forwardly along the tube from the electron source is an electron gun anode 24 which is tubular and hollow for passage of an axial electron beam as produced from the cathode.

A traveling wave tube according to the present embodiment further comprises pre-focus electrodes 26 which are anchored into the rods 12 when the latter are semi-molten during the manufacturing stage. Voltages are provided to the wafers 26 (by means not shown) for focussing the electron beam provided by the cathode.

Slow wave structure 16 comprises two intermeshing combs 28 and 30 wherein comb 28 comprises a metal base 32 having teeth 34 extending perpendicularly away from the base toward the opposite comb. The comb 30 comprises a base 36 and teeth 38 extending perpendicularly away from the base in the direction of comb 28. Each of the teeth comprises a flat metal wafer joined to its metal base, and provided with an aperture to form a passage for the electron beam, to which each of the teeth are perpendicularly disposed. Each of the teeth is maintained in spaced relation from the teeth of the opposite comb, and from the base of the opposite comb, to provide a circuitous transmission line path back and forth (and through slots 40) such that r.f. energy successively intersects the beam.

Figure 2A:
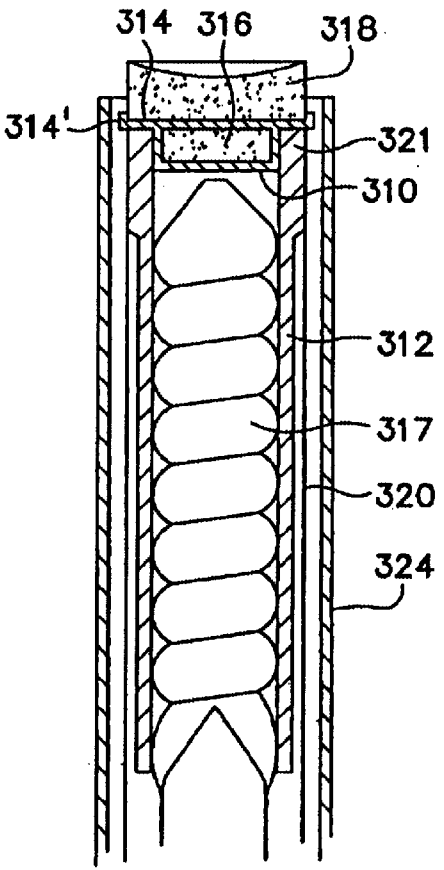
FIG. 2A is a view of a miniaturized cathode advantageously employed as part of the traveling wave tube of the present invention.
Figure 2:
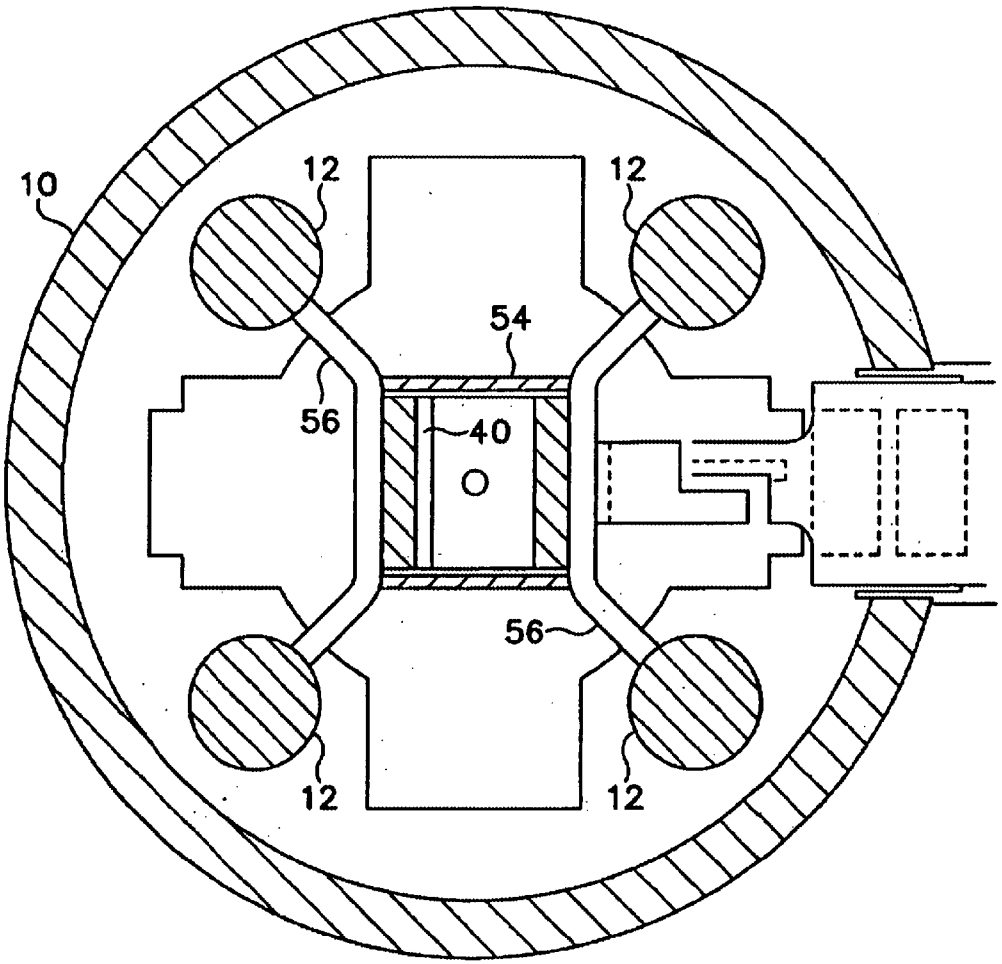
FIG. 2 is a cross section taken at 2—2 in FIG. 1.
Figure 4:
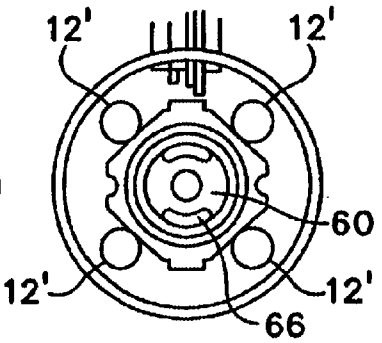
FIG. 4 is a cross section taken at A—A in FIG. 3.
Figure 3:
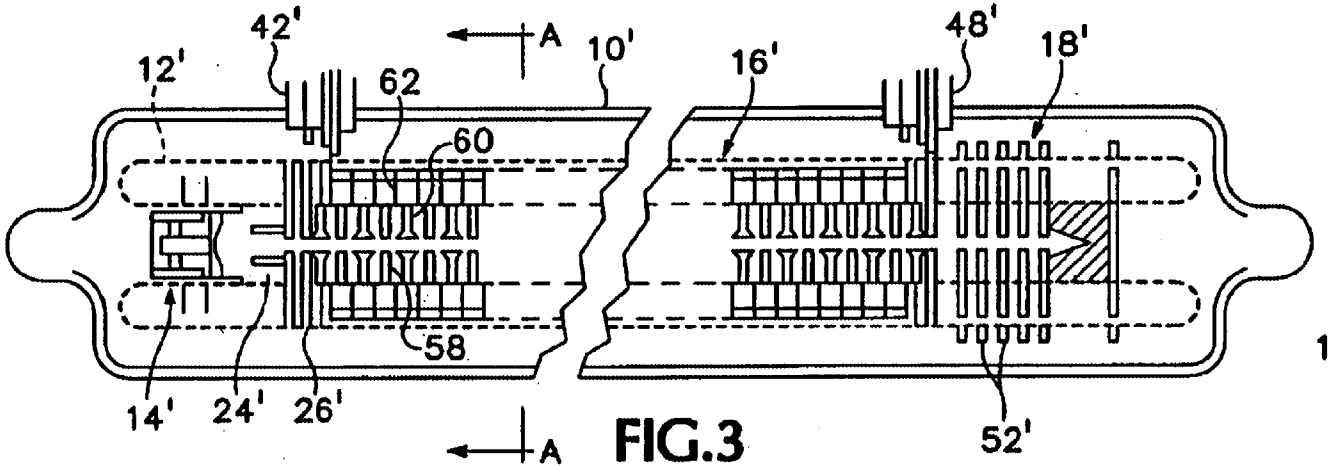
FIG. 3 is a cross-sectional view of another traveling wave tube according to the present invention including a slow wave structure comprising a plurality of coupled cavities.

The r.f. input is provided by r.f. coupling 42 connected to a wave guide 44 having a transformer structure 46 extending through the side of envelope 10 whereby energy flows axially inward through microwave window 45 toward the electron beam and then circuitously back and forth through the slots between each tooth and the opposite base to exit at wave guide structure 48 at the opposite end of the tube via glass window 50. Windows 45 and 50 maintain the vacuum within envelope 10. After the slow wave structure, the electron beam passes through a succession of metal collector wafers 52 which are apertured to receive the beam, a successively lower voltage being supplied to each wafer 52 for slowing down the beam. The sides of the slow wave structure are provided with a metal wall 54. The ladder structure comprising the combs 28 and 30 are positioned by means of a plurality of metal pins 56 extending inwardly from rods 12 as can be seen in FIG. 2.

In operation of this embodiment, differing voltages are applied to the combs so that the electron beam is alternately slowed down and accelerated as it passes through apertures in the combs' teeth, whereby to produce focussing of the beam. Amplification of the r.f. energy is produced at the output as energy is withdrawn from the electron beam.

The cathode 20 in the electron gun comprised a miniature flat cathode as further disclosed and claimed in my U.S. patent application Ser. No. 09/448,665, filed Nov. 24, 1999, entitled RESERVOIR DISPENSER CATHODE AND METHOD OF MANUFACTURE, and was approximately 0.05 inches in diameter. The miniature cathode is depicted in FIG. 2A and comprises a reservoir dispenser cathode having a reservoir cup 310 received within and supported by the upper portion of a cylindrical heater body 312. Cup 310 is provided with a radially outwardly extending flange 314 at its upper end which, during the manufacturing stage, initially extends substantially radially outwardly beyond the circumference of heater body 312. The reservoir cup 310 is formed of a refractory material, for example a tungsten-rhenium alloy, or platinum. The heater body 312 is suitably formed of molybdenum with a larger radius towards its upper end forming a hub 321 where it receives cup 310. Within the heater body 312 is provided heater 317.

Within the cup 310 is pressed an emission pellet 316 suitably comprising barium oxide mixed with tungsten powder. Just above cup 310 and supported by flange 314 is a diffuser plug 318 comprising a pelletized refractory material that is very porous and provided with a low work function overlay. The upper end of heater body 312 and particularly upper hub portion 321 thereof is received within and spot welded to support sleeve 320. A heat shield 324 surrounds sleeve 320.

Flange 314 is adapted to rest upon heater body 312, while in turn supporting the peripheral region of diffuser plug 18. The flange 314, where it extends radially outwardly, is employed as fusible welding material by laser welding to form a continuous circumferential weld bead 314' securing parts 318, 314, and 321 together in hermetically sealed relation. The weld bead provides a hermetic seal between cup and plug and is accomplished without impairment of the emissive material or the plug while retaining essential vapor pressure. This miniaturized cathode construction is an important feature in achieving the small, effective and economical traveling wave tube according to the present invention. This configuration avoids heavy constructions that are a detriment to miniaturization.

Although a Pierce type traveling wave tube gun structure is disclosed and preferred, a CRT type gun is also suitable. The voltage for anode 24 in the specific embodiment was 10 KV. The two combs were maintained, by means not shown, at voltages of 12 and 8 KV, respectively. The central aperture diameter of gun anode 24 and all succeeding wafers was 0.03 inches. The traveling wave tube of FIGS. 1 and 2 is suitable for operation at frequencies between 10 GHz and 32 GHz.

The apparatus of FIGS. 1 and 2 is manufactured by pressing four semi-molten glass rods 12 into tabs or pins located at the corners of the respective wafers. After rodding, the rodded assembly was placed in a stemming fixture and feed through stems were attached to either end of the assembly. Getters were mounted. Next the glass envelope was sealed on. The envelope is made of glass tubing that is flame sealed to the stems at each end. An annealing process followed. Then the tube was pumped and baked. The cathode was activated and then the tube was sealed off and removed from the pumps and getters were activated. Finally hipotting, cathode reactivation and aging took place for 24 hours.

The advantageous construction employing the glass envelope and rods produces high accuracy of alignment as well as economy of construction while incorporating electrostatic focussing. It would not be practical to integrate a glass envelope with a stack of iron magnetic pole pieces that could carry a magnetic field through the envelope to a point close to the beam, nor would it be feasible to mount and adjust magnets within the vacuum envelope. The glass rods hold the three sections in precise alignment and this method of attachment can be highly automated. The tube is able to develop 20 dB to 40 dB gain.

Although glass rods and a glass envelope are described, quartz or Pyrex may be substituted, especially for powers above 100 watts. The collector wafers illustrated at 52 are suitably formed of molybdenum or graphite while the remaining wafers in the structure can be formed of copper or copper plated stainless steel.

A further embodiment is illustrated in FIGS. 3 through 8 wherein corresponding elements are referred to employing primed reference numerals, including in this embodiment, a cathode 20', as depicted in FIG. 2A. The embodiment of FIGS. 3–8 differs principally in respect to an advantageous slow wave structure 16' comprising a plurality of conductive metal wafers supported by four insulating (e.g. glass) longitudinal rods 12' disposed longitudinally within insulating (e.g. glass) envelope 10'. As in the previous embodiment, the apparatus of FIGS. 3–8 utilizes electrostatic focussing and is disposed entirely within the glass envelope 10', i.e., it requires no focussing magnets either externally or internally of the structure. The glass rodded and enclosed construction renders the device easily manufactured whereby it can be economically produced in quantity.

Figure 5:
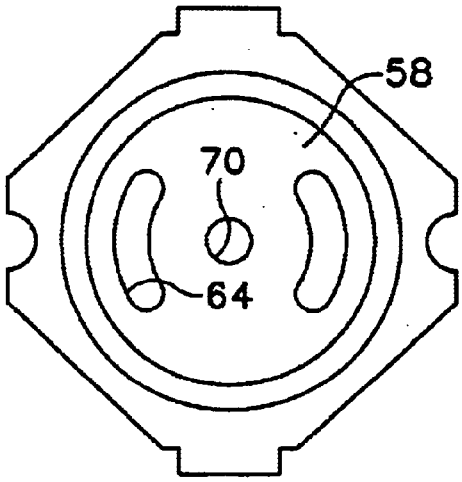
FIG. 5 is a view of a first wafer employed with the FIG. 4 structure.
Figure 6:
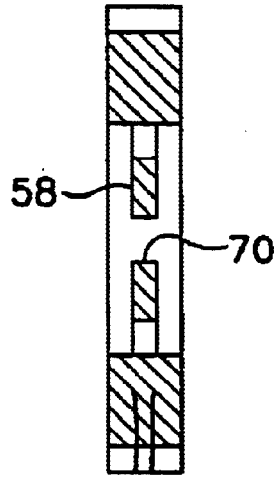
FIG. 6 is a vertical cross section of the FIG. 5 wafer.
Figure 7:
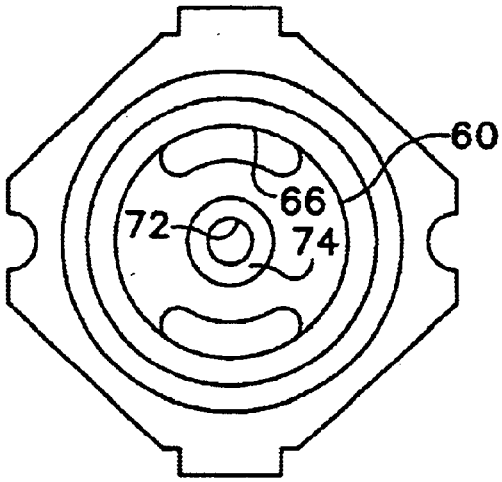
FIG. 7 is a view of a further wafer employed with the FIG. 3 structure.
Figure 8:
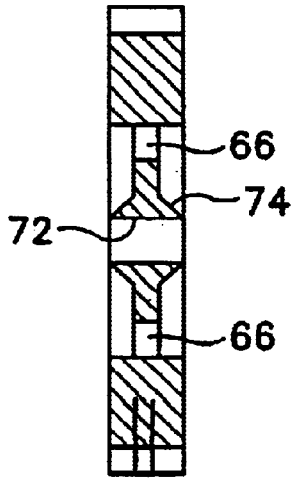
FIG. 8 is a vertical cross section of the FIG. 7 wafer.

Adjoining apertured metal wafers, 58 and 60, are separated and insulated from one another by insulating spacers 62 suitably formed of Kapton, and are provided with differing voltages as in the previous embodiment whereby to focus the electron beam through successive acceleration and deceleration of the beam. The identical structure is repeated along the tube with successive wafers of the 58 type, illustrated more fully in FIGS. 5 and 6, separated by wafers of the 60 type illustrated more fully in FIGS. 7 and 8. Wafers 58 are provided with curved coupling slots 64 disposed on opposite sides of central beam aperture 70, while wafers 60 are provided with similar curved coupling slots 66 on either side of central beam aperture 72 whereby to couple electromagnetic energy between successive cavities formed between successive wafers along the tube. As can be seen in FIGS. 5 and 6, the coupling slots 64 are here disposed at right angles to the coupling slots 66 in wafers 60, that is, they are offset circumferentially by 90 degrees from one another.

The wafers 58 and 60 are thicker in their radially outward region whereby to abut one another along the stack, except for the Kapton insulation layer therebetween. The wafer 60 also has a central boss 74 through which the beam aperture 72 is provided, and this boss is axially thinner than the peripheral portion of the wafer.

R.F. input at 42' is coupled to the slow wave structure and therealong through cavities formed between successive wafers, and via the slots 64 and 66. The r.f. is propagated along the cavity stack, taking energy from the beam, with an amplified output being provided at 48'.

Figure 9A:
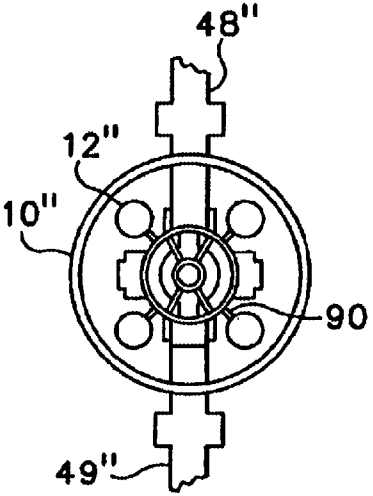
FIG. 9A is a cross-sectional view taken at A-A in FIG. 9.
Figure 9:
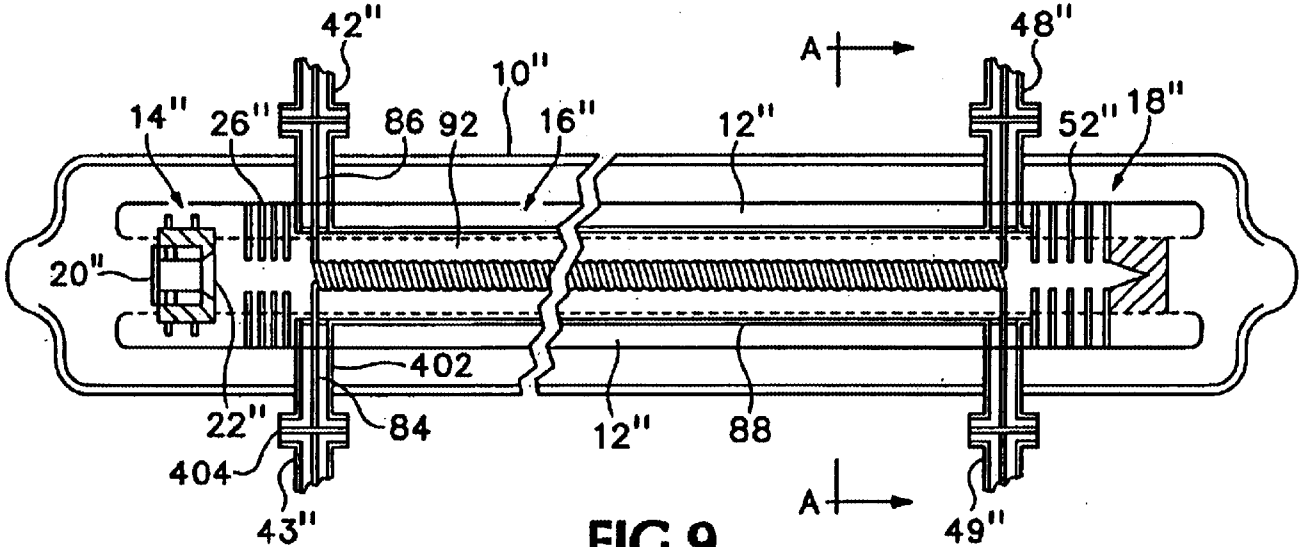
FIG. 9 is a cross-sectional view of a further embodiment according to the present invention employing a double helix in a slow wave circuit.
Figure 11:
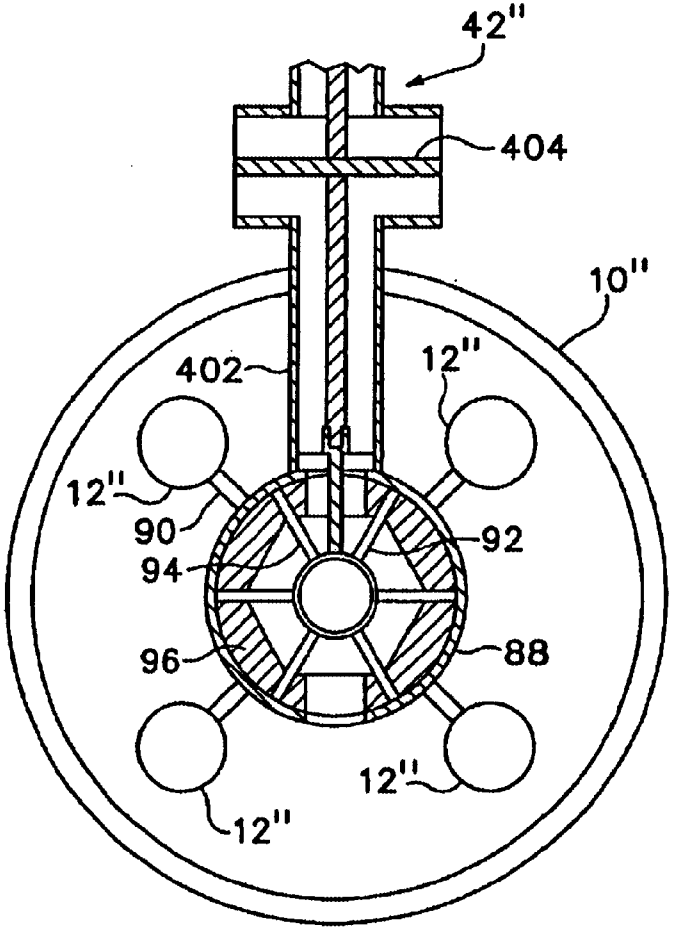
FIG. 11 is a partial cross-sectional view taken at 11—11 in FIG. 10.
Figure 10:
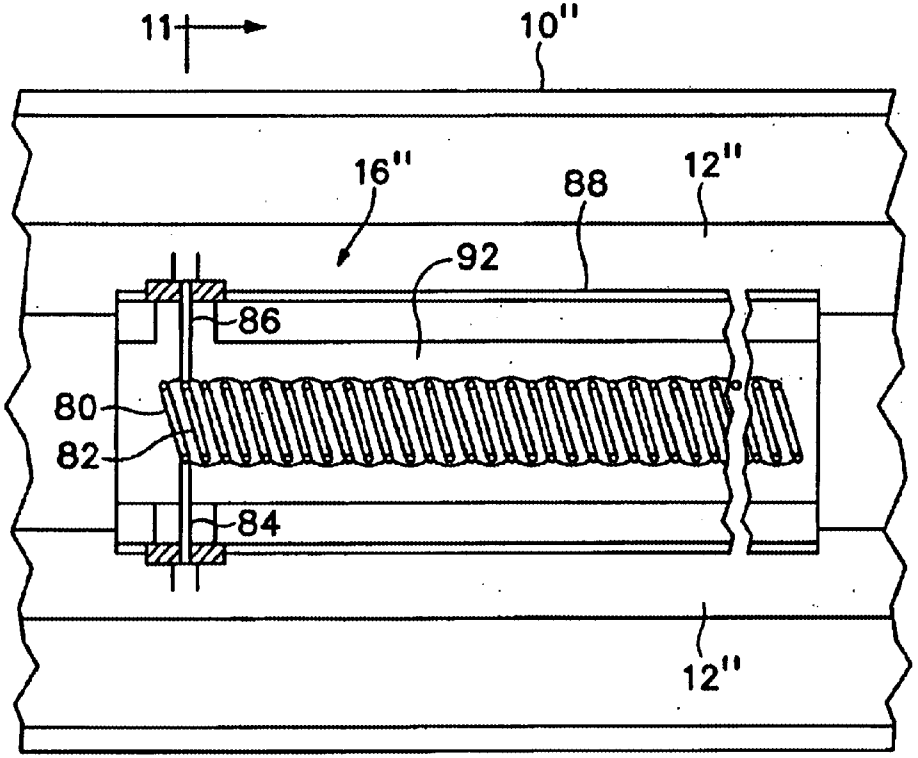
FIG. 10 is a more detailed view of a portion of the double helix slow wave circuit of FIG. 9.

A still further embodiment of the present invention is illustrated in FIGS. 9 through 11 wherein double primed reference numerals are employed to indicate elements similar to those discussed in the prior embodiments.

The traveling wave tube again comprises an elongated glass envelope, here numbered 10", cylindrical in shape and supporting therewithin a plurality of longitudinal glass rods 12". There are four such rods running substantially the length of the glass envelope, parallel to the axis of the envelope, in spaced relation within the wall of the envelope. The rods in turn support electron gun 14", slow wave structure 16" and collector structure 18". The electron gun has an electrically central cathode 20" centered within the central aperture of a Pierce type focus electrode 22". The traveling wave tube according to the present embodiment further comprises prefocus electrodes 26" which are anchored into rods 12" when the latter are semi-molten during the manufacturing stage. Voltages are provided to the wafers 26", (by means not shown) for focussing the electron beam provided by the cathode.

In this embodiment, slow wave structure 16" comprises a double helix including a first helix 80 and a second helix 82 wound together in interleaved fashion such that the central electron beam successively passes a turn of one helix and then a turn of the other as the beam is focussed axially by the helices. The helices are maintained within the envelope at different voltages, to maintain beam focussing, via central r.f. conductors 84 and 86 which form a coaxial central lead of r.f. input means 42" and 43", respectively. Each of the coaxial r.f. input means further comprises an outer conductor 402 and a larger diameter window 404 where the central conductor, e.g. conductor 84, is discontinuous to provide voltage isolation while being capacitively coupled through the window. The helices 80 and 82 are located within metal ground plane cylinder 88 extending longitudinally within the envelope 10" and supported from insulating rods 12" on metal pins 90 extending from each of the rods 12", to cylinder 88. The cylinder 88 is joined to the outer conductors of the input and output means while the inner conductors pass through to the helices. Six longitudinal dielectric fins 92, 94, suitably formed of alumina or other dielectric material, extend inwardly from the inside of cylinder 88 in supporting relation to the helices. Three first fins 92 support helix 80, while three other fins 94, separated from fins 92 by 60 degrees and interleaved therewith, support the remaining helix 82. As can be seen in FIG. 10, fins 82 touch helix 80 but not helix 82. Similarly, fins 94 touch helix 82 but not helix 80. Supports 96 within cylinder 88 are disposed crossways of the tube at spaced locations whereby to position the alumina fins 92 and 94. The beam is focussed within the slow wave structure inasmuch as the helices 80 and 82 have appropriately different focussing voltages applied thereto on conductors 84 and 86 within the tube. Meanwhile, amplification of the r.f. energy input at input means 42", 43" is provided for output at output means 48", 49" which are constructed in the same manner as the input means. Properly phased r.f. input signals are provided at input means 42" and 43" to account for movement of the electron beam between turns of the two helices.

After the slow wave structure, the electron beam passes through a succession of metal collector wafers 52" which are apertured to receive the beam, successively lower voltage being supplied to each wafer 52" for slowing down the beam.

In operation, as differing voltages are applied to the two helices, the electron beam is alternately slowed down and accelerated as it passes along the axis of the tube, whereby to produce focussing of the beam. Amplification of the r.f. energy is produced at the output as energy is withdrawn from the electron beam. The advantageous construction employing the envelope and rods produces high accuracy of alignment as well as economy of construction while incorporating electrostatic focussing. Although glass rods and a glass envelope are described, quartz or Pyrex may be substituted.

A still further and preferred embodiment of the present invention is illustrated in FIGS. 12 through 17. Reference numerals having the same last two digits as elements discussed in respect to the previous embodiments, are employed to refer to similar elements. The construction of this embodiment, as it pertains to similar elements, is substantially as hereinbefore described. The traveling wave tube comprises an elongated tubular glass envelope 110, cylindrical in shape, and supporting therewithin a plurality of longitudinal glass rods 112. There are four such rods running substantially the length of the glass envelope, parallel to the axis of the envelope, in spaced relation within the wall of the envelope. The rods in turn support electron gun 114, a slow wave structure 116 and a collector structure 118. The electron gun has an electrically central cathode 120 centered within the central aperture of a Pierce type focus electrode 122. Spaced forwardly along the tube from the electron source is a first anode 124 and a second, cup shaped anode 125, both apertured to pass the electron beam provided from the cathode. In a specific embodiment, focus electrode and cathode 120 and 122 were maintained at −7.3 KV, anode 124 at +3.5 KV and anode 125 at +5.5 KV with respect to grounded cylinder 188 of the slow wave structure.

Slow wave structure 116 comprises a double ring loop configuration including first and second sets of aligned, coaxial metal rings wherein, for example, rings 202, 203, 204 for a first set are interleaved with rings 206, 207, 208 of a second set. The rings of a set, e.g. rings 202, 203, 204, are serially interconnected along the slow wave structure and similarly, the rings 206, 207, 208 are also serially interconnected along the slow wave structure. In the illustrated embodiment, and referring particularly to FIG. 16, rings 202 and 203 are interconnected by a radially outwardly extending loop 212. Rings of the second set, for example rings 207 and 208, are serially interconnected by a radially outwardly extending loop 214 which is circumferentially displaced from loop 212 by 90 degrees about the axis of the stack of rings.

The rings of a set as well as the interconnecting loops are formed from a flat metal material from which the whole structure is suitably stamped or laser cut and bent in a jig to the shape shown, after which the same is heat-treated to enable it to maintain the configuration. The circumferential width of each loop is comparable to the radial width of a ring, i.e. the difference between the inside radius and the outside radius of a ring. It will be seen that the interconnecting loops for a given set of rings, e.g. loop 212 and loop 216, are disposed on alternate sides of the stack of rings and proceed along the stack in the same manner for completing a serial circuit of rings from one end of the slow wave structure to the other. Similarly, loops 213 and 214 connect rings of the other set. Each of the two sets of rings and their interconnecting loops provide a transmission line structure together with the ground plane metal cylinder 188 within which the rings are coaxially received. As hereinafter indicated, the two interleaved ring loop structures are provided with different d.c. voltages in order to maintain focussing of the electron beam as it passes coaxially within the rings.

Figure 12:
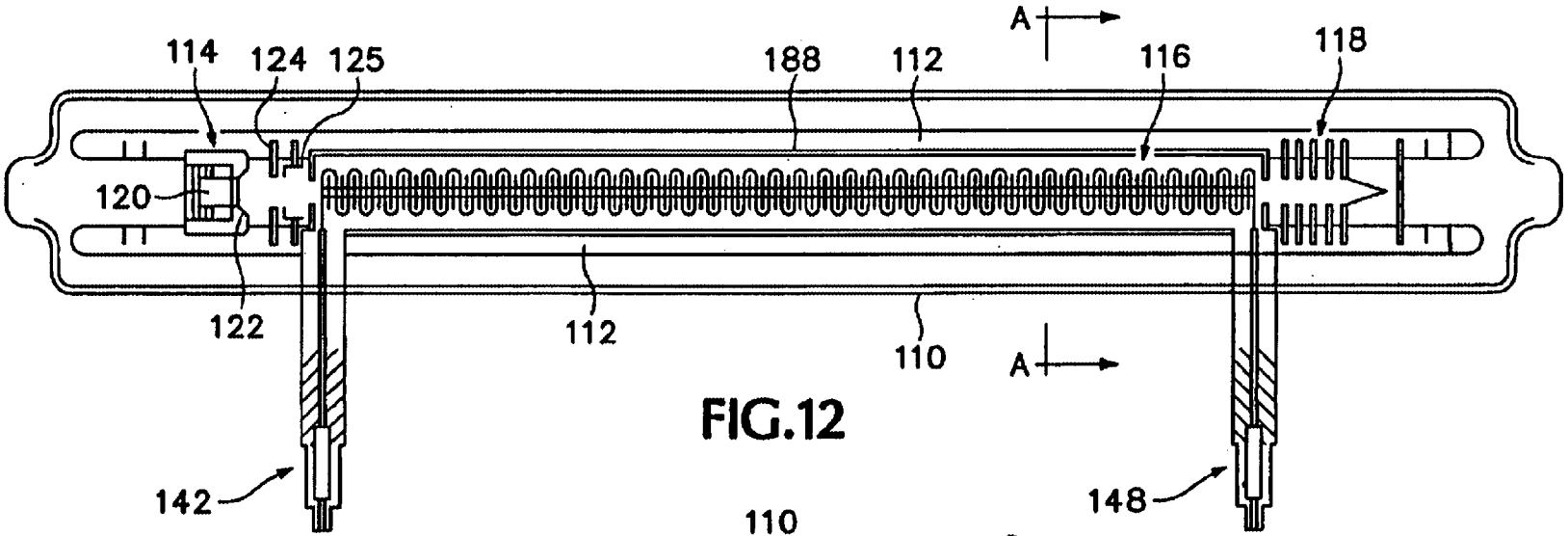
FIG. 12 is a longitudinal cross-sectional view of another traveling wave tube according to the present invention including a double ring loop slow wave structure.
Figure 13:
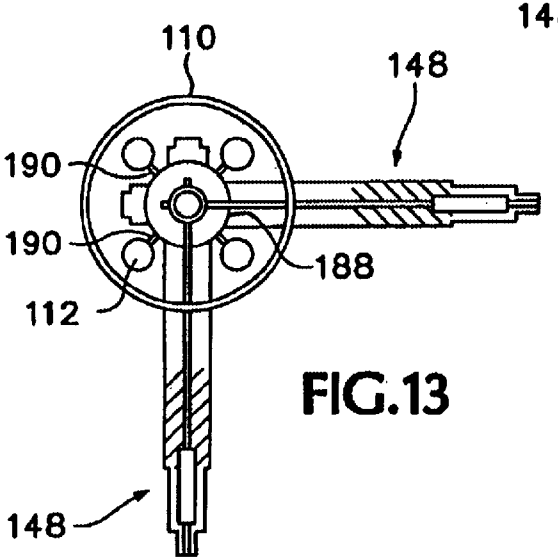
FIG. 13 is a cross section taken at A—A in FIG. 12.
Figure 14:
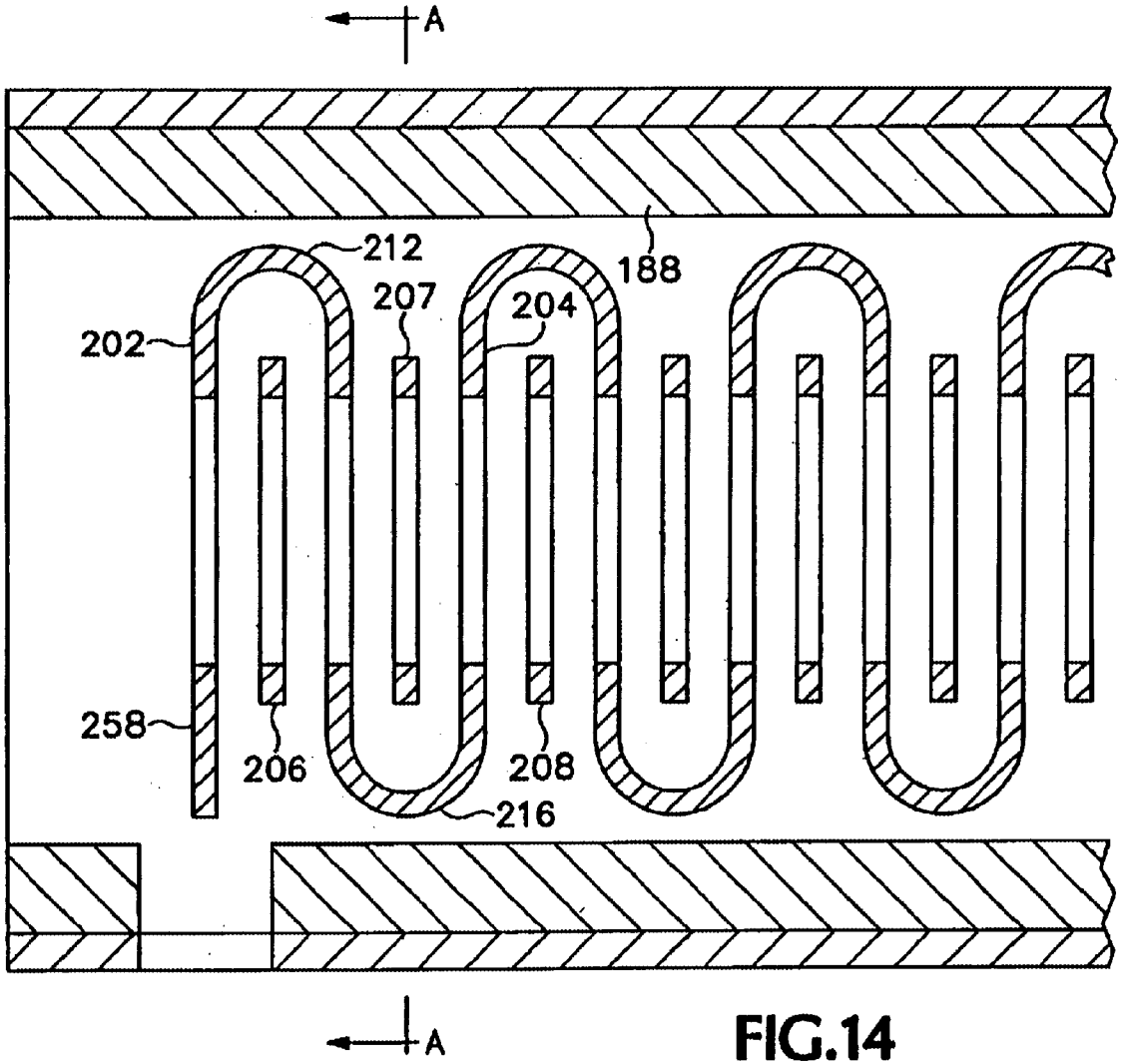
FIG. 14 is a partial longitudinal cross-sectional view of the FIG. 12 tube.

Referring more particularly to FIGS. 12 and 13, the r.f. input to the tube is supplied via input coaxial coupling devices 142 in proper phase relation to one another to feed the two sets of rings, while output is provided via coaxial output coupling devices 148. The two input devices 142 are disposed at 90 degrees to one another about the axis of the tube, each feeding a different set of rings, and the output devices 148 are similarly disposed and provide outputs for the two respective sets of rings.

Figure 15:
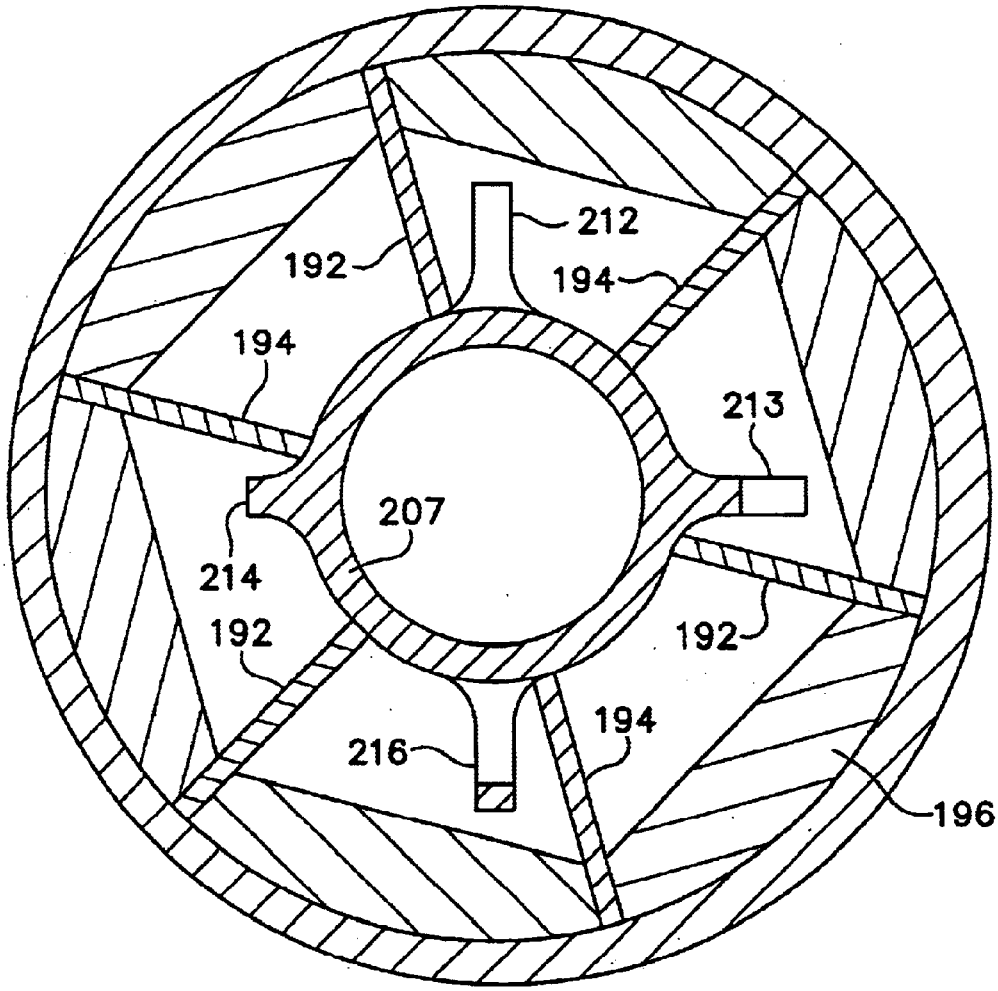
FIG. 15 is a cross section taken at A—A in FIG. 14.
Figure 16:
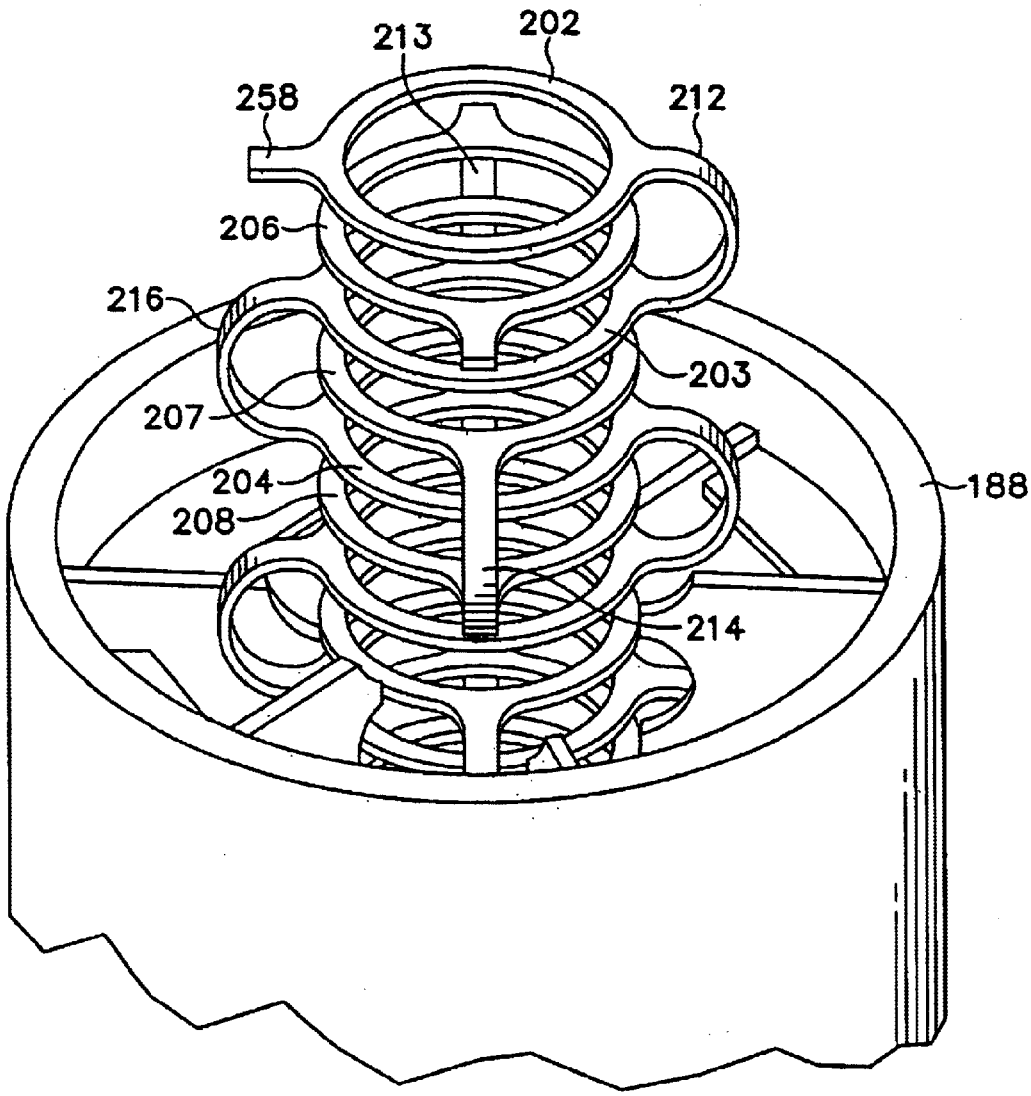
FIG. 16 is a partially broken-away perspective view of part of the FIG. 12 tube, particularly illustrating the slow wave structure.

The double ring loop structure is positioned within metal ground plane cylinder 188 extending longitudinally of envelope 110 and supported from insulating rods 112 via metal pins 190 extending from each of the rods 112 to the cylinder 188. The cylinder 188 is joined to the outer conductors of input and output devices while the inner conductors (within the envelope) pass through apertures in the cylinder and connect to end loops of the ring loop structure. Six longitudinal dielectric fins 192, 194, suitably formed of alumina, extend inwardly from the inside of cylinder 188 in supporting relation to the rings. For example, first fins 192 support rings 202, 203, 204, while fins 194, separated from fins 192 by 60 degrees and interleaved therewith, support rings 206, 207, 208. As can be seen in FIG. 15, fins 194 touch ring 207 but not the rings on either side. Similarly, fins 192 touch only the rings of the remaining set. Supports 196 within cylinder 188 are disposed crossways of the tube at spaced locations whereby to position the alumina fins 192 and 194.

Figure 17:
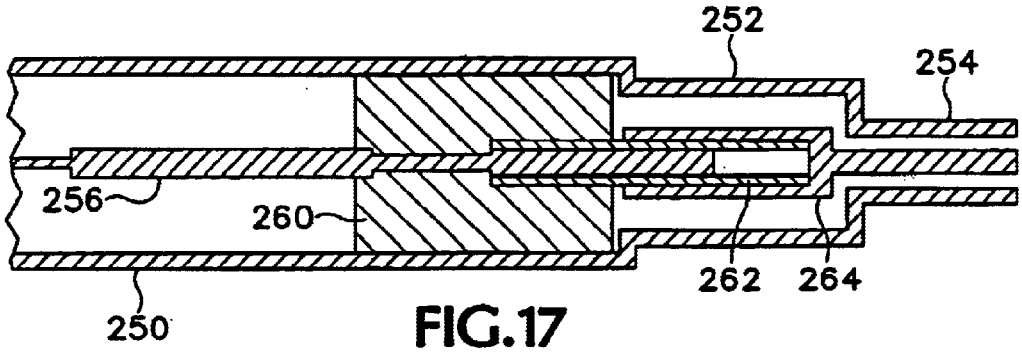
FIG. 17 is a longitudinal cross section of an input or output coaxial coupling transformer employed with the FIG. 12 embodiment.

FIG. 17 illustrates a coaxial coupling device 142 used for accomplishing r.f. input to the slow wave structure. Both input devices as well as output devices 148 are suitably identical. Each such coupling device comprises a cylindrical exterior metal conductor 250 for extending in sealed relation through the wall of envelope 110 and being stepped down in diameter as indicated at 252 and 254, exteriorly of the envelope, to provide impedance matching to an input (or output) coaxial cable or the like. On the interior side of the envelope wall, exterior conductor 250 is joined to the cylinder 188 while the central conductor 256 of the coupling device is suitably integral with, for example, tab 258 providing connection to a first ring 202 of the first ring loop set.

The outer and inner conductors of the coupling device in FIG. 17 are separated by annular insulating member 260 that positions the central conductor 256 within the outer conductor 250. Toward the exterior end of the coupling device, annular member 260 receives therewithin a ceramic standoff cylinder 262 which separates central conductor 256 from a central coaxial conductor 264 providing connection at the exterior of the tube envelope. Central conductor 264 is enlarged within a stepped down portion 252 of the exterior conductor, in part to enhance the impedance matching function, and is centrally bored to receive central standoff member 262. The thickness of the ceramic standoff member is such as to provide capacitive coupling between central coaxial conductors 256 and 264, while at the same time supplying insulation at the d.c. level whereby focussing voltages can be provided (by means not shown) to the central conductor 256 within the envelope and accordingly to the rings of the corresponding set. Turning to FIG. 12, subsequent to the slow wave structure 116 along the electron beam, said beam passes through a succession of metal collector wafers 118 which are apertured to receive the beam, a successively lower voltage being applied to each wafer 118 for slowing down the beam.

In operation of this embodiment, differing d.c. voltages are applied to the respective sets of rings so that the electron beam is alternately slowed down and accelerated as it passes through the rings, whereby to produce focussing of the beam. In a specific embodiment these voltages were +4 KV and −4 KV with respect to the ground plane cylinder. Amplification of the r.f. energy supplied at the input r.f. coupling devices 142 is provided at the output coaxial coupling devices 148, as energy is withdrawn from the electron beam.

The overall manufacture of the tube of FIGS. 12–17 is substantially the same as hereinbefore described. The advantageous construction employing the glass envelope and rods produces high accuracy of alignment as well as economy of construction while incorporating electrostatic focussing. As hereinbefore mentioned, despite the advantages of glass envelope construction, it would not be practical to integrate a glass envelope with a stack of iron magnetic pole pieces that could carry a magnetic field through the envelope to a point close to the beam, nor would it be feasible to mount and adjust magnets within the vacuum envelope. Also, in the case of the ring loop structure, the loops extending outwardly would render placement of the magnets even more difficult, even if the magnets could be placed within the vacuum envelope.

The glass rods hold the sections of the electrostatic structure in precise alignment and the method of manufacture can be highly automated. Although glass rods and a glass envelope are described, quartz or Pyrex or other materials may be substituted. The collector wafers illustrated at 152 are suitably formed of molybdenum while the rings and loops are also suitably formed of molybdenum. The embodiment of FIGS. 12 through 17 is preferred because of economy of construction as well as enhanced immunity from backward wave oscillation.

While preferred embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A traveling wave tube comprising:

an electron gun structure, a slow wave structure through which an electron beam provided by said electron gun structure passes, and a collector structure, an elongated envelope enclosing said structures, said envelope being formed of insulating material and provided with a plurality of rods also formed of insulating material and supported longitudinally inside said envelope, said rods in turn rigidly supporting and aligning said electron gun structure, said slow wave structure, and said collector structure, and means for coupling an r.f. signal input to and receiving an r.f. signal output from said slow wave structure, wherein said slow wave structure has voltage applied thereto for providing electrostatic focussing of said electron beam, said slow wave structure providing amplification of the r.f. signal by interaction with said electron beam.

2. The traveling wave tube according to claim 1 wherein said rods are formed of glass.

3. The traveling wave tube according to claim 1 wherein said envelope is formed of glass.

4. A traveling wave tube comprising:

an electron gun structure and a slow wave structure through which an electron beam provided by said electron gun structure passes, an elongated envelope enclosing said structures, said envelope being formed of insulating material and provided with a plurality of rods also formed of insulating material and supported longitudinally in said envelope, said rods in turn rigidly supporting said electron gun structure and said slow wave structure, and means for coupling an r.f. signal input to and receiving an r.f. signal output from said slow wave structure, wherein said slow wave structure provides electrostatic focussing of said electron beam as well as amplification of the r.f. signal by interaction with said electron beam, wherein at least one of said structures comprises a plurality of spaced conducting wafers along the path of said beam which are apertured to receive said electron beam and wherein differing voltages are applied to alternate wafers.

5. A traveling wave tube comprising:

an electron gun structure and a slow wave structure through which an electron beam provided by said electron gun structure passes, an elongated envelope enclosing said structures, said envelope being formed of insulating material and provided with a plurality of rods also formed of insulating material and supported longitudinally in said envelope, said rods in turn rigidly supporting said electron gun structure and said slow wave structure, and means for coupling an r.f. signal input to and receiving an r.f. signal output from said slow wave structure, wherein said slow wave structure provides electrostatic focussing of said electron beam as well as amplification of the r.f. signal by interaction with said electron beam, and wherein said slow wave structure comprises a ladder circuit having voltage applied thereto for producing said focussing of said beam, said slow wave structure providing amplification of r.f. energy.

6. A traveling wave tube comprising:

an electron gun structure and a slow wave structure through which an electron beam provided by said electron gun structure passes, an elongated envelope enclosing said structures, said envelope being formed of insulating material and provided with a plurality of rods also formed of insulating material and supported longitudinally in said envelope, said rods in turn rigidly supporting said electron gun structure and said slow wave structure, and means for coupling an r.f. signal input to and receiving an r.f. signal output from said slow wave structure, wherein said slow wave structure provides electrostatic focussing of said electron beam as well as amplification of the r.f. signal by interaction with said electron beam, wherein said slow wave structure comprises a ladder circuit for said, focussing of said beam as well as amplifying r.f. energy, and wherein said electron gun structure includes a reservoir dispenser cathode having a reservoir cup with a radially outwardly extending flange and receiving therewithin an emissive material, and further including a diffuser plug comprising porous refractory material supported on said flange, said flange further comprising a circumferential weld bead securing said diffuser plug to said flange in sealing relation.

7. A traveling wave tube comprising:

an electron gun structure and a slow wave structure through which an electron beam provided by said electron gun structure passes, an elongated envelope enclosing said structures, said envelope being formed of insulating material and provided with a plurality of rods also formed of insulating material and supported longitudinally in said envelope, said rods in turn rigidly supporting said electron gun structure and said slow wave structure, and means for coupling an r.f. signal input to and receiving an r.f. signal output from said slow wave structure, wherein said slow wave structure provides electrostatic focussing of said electron beam as well as amplification of the r.f. signal by interaction with said electron beam, and wherein said slow wave structure comprises a coupled cavity stack having voltage applied thereto for producing said focussing of said beam, said slow wave structure providing amplification of r.f. energy.

8. A traveling wave tube comprising:

an electron gun structure and a slow wave structure through which an electron beam provided by said electron gun structure passes, an elongated envelope enclosing said structures, said envelope being formed of insulating material and provided with a plurality of rods also formed of insulating material and supported longitudinally in said envelope, said rods in turn rigidly supporting said electron gun structure and said slow wave structure, and means for coupling an r.f. signal input to and receiving an r.f. signal output from said slow wave structure, wherein said slow wave structure provides electrostatic focussing of said electron beam as well as amplification of the r.f. signal by interaction with said electron beam, wherein said slow wave structure comprises a coupled cavity stack for said focussing of said beam as well as amplifying r.f. energy, and wherein said electron gun structure includes a reservoir dispenser cathode having a reservoir cup with a radially outwardly extending flange and receiving therewithin an emissive material and further including a diffuser plug comprising porous refractory material supported on said flange, said flange further comprising a circumferential weld bead securing said diffuser plug to said flange in sealing relation.

9. A traveling wave tube comprising:

an electron gun structure and a slow wave structure through which an electron beam provided by said electron gun structure passes, an elongated envelope enclosing said structures, said envelope being formed of insulating material and provided with a plurality of rods also formed of insulating material and supported longitudinally in said envelope, said rods in turn rigidly supporting said electron gun structure and said slow wave structure, and means for coupling an r.f. signal input to and receiving an r.f. signal output from said slow wave structure, wherein said slow wave structure provides electrostatic focussing of said electron beam as well as amplification of the r.f. signal by interaction with said electron beam, and wherein said slow wave structure comprises a double ring loop structure including interleaved loops in separate circuits for focussing said beam as well as amplifying r.f. energy.

10. A traveling wave tube comprising:

an electron gun structure and a slow wave structure through which an electron beam provided by said electron gun structure passes, an elongated envelope enclosing said structures, said envelope being formed of insulating material and provided with a plurality of rods also formed of insulating material and supported longitudinally in said envelope, said rods in turn rigidly supporting said electron gun structure and said slow wave structure, and means for coupling an r.f. signal input to and receiving an r.f. signal output from said slow wave structure, wherein said slow wave structure provides electrostatic focussing of said electron beam as well as amplification of the r.f. signal by interaction with said electron beam, and wherein said slow wave structure comprises a double helix structure for focussing said beam as well as amplifying r.f. energy and wherein said double helix structure comprises first and second helices, the turns of the first helix being substantially coaxial with and interleaved with the turns of the second helix, the two helices being maintained at different voltage levels for focussing, wherein adjacent turns are at different voltage levels.

11. A traveling wave tube comprising:

an electron gun structure and a slow wave structure through which an electron beam provided by said electron gun structure passes, an elongated envelope enclosing said structures, said envelope being formed of insulating material and provided with a plurality of rods also formed of insulating material and supported longitudinally in said envelope, said rods in turn rigidly supporting said electron gun structure and said slow wave structure, and means for coupling an r.f. signal input to and receiving an r.f. signal output from said slow wave structure, wherein said slow wave structure provides electrostatic focussing of said electron beam as well as amplification of the r.f. signal by interaction with said electron beam, and wherein said slow wave structure comprises a ladder circuit including a pair of interleaved conductive combs insulated from one another and maintained at different voltage level for focussing said beam, said slow wave structure providing amplification of r.f. energy, each comb having a body and outwardly extending teeth, wherein the teeth of each comb comprise apertured wafers for passing said electron beam, the ends of the teeth of one comb being spaced from the body of the remaining comb to provide a folded transmission line passage through which r.f. energy is propagated.

12. A traveling wave tube comprising:

an electron gun structure and a slow wave structure through which an electron beam provided by said electron gun structure passes, an elongated envelope enclosing said structures, said envelope being formed of insulating material and provided with a plurality of rods also formed, of insulating material and supported longitudinally in said envelope, said rods in turn rigidly supporting said electron gun structure and said slow wave structure, and means for coupling an r.f. signal input to and receiving an r.f. signal output from said slow wave structure, wherein said slow wave structure provides electrostatic focussing of said electron beam as well as amplification of the r.f. signal by interaction with said electron beam, and wherein said slow wave structure comprises a coupled cavity stack including a plurality of conducting wafers apertured to receive said electron beam and supported by said insulating rods, wherein said wafers are centrally spaced along said electron beam to form cavities therebetween which are coupled to provide a path through which r.f. energy is propagated, adjacent wafers being insulated from one another and maintained at different voltage levels for said focussing.

13. A traveling wave tube comprising:

an electron gun structure and a slow wave structure through which an electron beam provided by said electron gun structure passes, an elongated envelope enclosing said structures, said envelope being formed of insulating material and provided with a plurality of rods also formed of insulating material and supported longitudinally in said envelope, said rods in turn rigidly supporting said electron gun structure and said slow wave structure, and means for coupling an r.f. signal input to and receiving an r.f. signal output from said slow wave structure, wherein said slow wave structure provides electrostatic focussing of said electron beam as well as amplification of the r.f. signal by interaction with said electron beam, and wherein said slow wave structure comprises a stack of spaced coaxially aligned conducting rings having central apertures aligned to receive said electron beam, including a first set of spaced rings and means serially connecting the rings of said first set along said slow wave structure, said stack further including a second set of spaced rings coaxial with, interleaved with and spaced between the rings of the first set and means serially connecting the rings of the second set along said slow wave structure, and means for providing different voltages to the rings of the first and second sets to maintain beam focussing.

14. A traveling wave tube comprising:

an electron gun structure and a slow wave structure through which an electron beam provided by said electron gun structure passes, an elongated envelope enclosing said structure, said envelope being formed of insulating material and provided with a plurality of rods also formed of insulating material and supported longitudinally in said envelope, said rods in turn rigidly supporting said electron gun structure and said slow wave structure, and means for coupling an r.f. signal input to and receiving an r.f. signal output from said slow wave structure, wherein said slow wave structure provides electrostatic focussing of said electron beam as well as amplification of the r.f. signal by interaction with said electron beam, and wherein said slow wave structure comprises a stack of conducting rings having central apertures aligned to receive said electron beam, including a first set of spaced rings serially interconnected by first loops peripheral to said rings on alternate sides of said stack, and a second set of spaced rings interleaved with and spaced between the rings of the first set, said rings of said second set being serially interconnected by second loops peripheral to said rings of said second set on alternate sides of said stack, said second loops being circumferentially spaced around said stack from the first loops, and means for providing different voltages to the rings of the first and second set respectively to maintain beam focussing.

15. A traveling wave tube comprising:

an electron gun structure and a slow wave structure through which an electron beam provided by said electron gun structure passes, and a collector structure, an elongated envelope enclosing said structures, said envelope being formed of insulating material and provided with a plurality of rods also formed of insulating material and supported longitudinally in said envelope, said rods in turn rigidly supporting said electron gun structure and said slow wave structure, and means for coupling an r.f. signal input to and receiving an r.f. signal output from said slow wave structure, wherein said slow wave structure provides electrostatic focussing of said electron beam as well as amplification of the r.f. signal by interaction with said electron beam, and wherein said collector structure comprises a plurality of spaced conducting wafers apertured to receive said electron beam and supported by said insulating rods, said wafers being maintained at successively lower voltage levels along said beam.

16. The traveling wave tube according to claim 15 wherein said wafers are formed of molybdenum or graphite.

17. A traveling wave tube comprising:

an electron gun structure and a slow wave structure through which an electron beam provided by said electron gun structure passes, said slow wave structure comprising at least several metal wafers disposed along the path of said electron beam, said wafers being centrally apertured to pass said electron beam, and insulating rods supporting said wafers, successive wafers along the path of said electron beam being insulated from one another and receiving different voltages for focussing said electron beam, wherein successive wafers are spaced from one another adjacent the path of said electron beam to form electromagnetic cavities coupled from one to the next along said beam to provide a path through which electromagnetic energy is propagated.

18. A traveling wave tube comprising:

an electron gun structure and a slow wave structure through which an electron beam provided by said electron gun structure passes, said slow wave structure comprising a stack of conductive metal rings including a first set of serially interconnected rings, and a second set of serially interconnected rings wherein the rings of the second set are interleaved between the rings of the first set, and means for providing different electron beam focussing voltages to the first and second sets of rings respectively.

19. A traveling wave tube comprising:

an electron gun structure, a collector structure, and a slow wave structure intermediate said electron gun structure and said collector structure and through which an electron beam provided by said electron gun structure passes, an elongated envelope enclosing said structures, said envelope being formed of insulating material and provided with a plurality of insulating rods disposed longitudinally therewithin for in turn supporting said electron gun structure, said collector structure, and said slow wave structure, means for coupling an r.f. signal input to and receiving an r.f. signal output from said slow wave structure, wherein said slow wave structure provides electrostatic focussing of said electron beam as well as amplification of the r.f. signal by interaction with said electron beam, wherein said slow wave structure comprises a stack of conducting rings having central apertures aligned to receive said electron beam, including a first set of spaced rings serially interconnected by first loops peripheral to said rings on alternate sides of said stack, and a second set of spaced rings interleaved with and spaced between the rings of the first set, said rings of said second set being serially interconnected by the second loops peripheral to said rings of said second set on alternate sides of said stack, said second loops being circumferentially spaced around said stack from the first loops, and means for providing different voltages to the rings of the first and second set respectively to maintain beam focussing.

20. A traveling wave tube comprising:

an electron gun structure, a collector structure, and a slow wave structure intermediate said electron gun structure and said collector structure and through which an electron beam provided by said electron gun structure passes, an elongated envelope enclosing said structures, said envelope being formed of insulating material and provided with a plurality of insulating rods disposed longitudinally therewithin for in turn supporting said electron gun structure, said collector structure, and said slow wave structure, means for coupling an r.f. signal input to and receiving an r.f. signal output from said slow wave structure, wherein said slow wave structure provides electrostatic focussing of said electron beam as well as amplification of the r.f. signal by interaction with said electron beam, wherein said slow wave structure comprises a stack of conducting rings having central apertures aligned to receive said electron beam, including a first set of spaced rings and first loops peripheral to said rings for interconnecting said rings on alternate sides of said stack, and a second set of spaced rings interleaved with and spaced between the rings of the first set, and second loops peripheral to said rings of said second set on alternate sides of said stack for interconnecting rings of said second set, said second loops being circumferentially spaced around said stack from the first loops, a metal ground plane cylinder receiving said sets of rings in spaced relation therewithin, a first set of dielectric fins extending longitudinally within said ground plane cylinder and radially inwardly in supporting relation to rings of the first set, and a second set of dielectric fins extending longitudinally of said ground plane cylinder and radially therewithin in supporting relation to the second set of rings, wherein the fins supporting the first set of rings are circumferentially spaced about the axis of said cylinder from the fins supporting the other set of rings, means supporting said cylinder from said insulating rods, and means for providing different voltages to the rings of the first and second set respectively to maintain beam focussing.

21. A traveling wave tube comprising:

an electron gun structure, a collector structure, and a slow wave structure intermediate said electron gun structure and said collector structure and through which an electron beam provided by said electron gun structure passes, an elongated envelope enclosing said structures, said envelope being formed of insulating material and provided with a plurality of insulating rods disposed longitudinally therewithin for in turn supporting said electron gun structure, said collector structure, and said slow wave structure, means for coupling an r.f. signal input to and receiving an r.f. signal output from said slow wave structure, wherein said slow wave structure provides electrostatic focussing of said electron beam as well as amplification of the r.f. signal by interaction with said electron beam, wherein said slow wave structure comprises first and second helices, the turns of the first helix being substantially coaxial with and interleaved with the turns of the second helix, a ground plane cylinder supported within said elongated envelope and in turn receiving said helices in spaced relation hereto, a first set of dielectric fins extending longitudinally within said ground plane cylinder and radially therewithin in supporting relation to one of said helices, and a second set of dielectric fins extending longitudinally within said ground plane cylinder and radially therewithin in supporting relation to the second of said helices, the fins of the second set being circumferentially spaced within said ground plane cylinder from the fins of the first set, and means supporting said metal ground plane cylinder from said insulating rods, and means for providing different voltages to the respective helices.

22. The method of manufacturing a traveling wave tube comprising:

supporting an electron gun structure, a collector structure, and a slow wave structure in alignment in between said electron gun structure and said collector structure by joining said structures to a common set of insulating rods disposed in surrounding relation to said structures, and positioning said rods and said structures within a common insulating envelope extending longitudinally of said rods in enclosing relation thereto.

23. The method according to claim 22 wherein joining said structures to said common set of insulating rods is accomplished by bringing said rods to a semi-molten state and embedding portions of at least ones of said structures into said rods while said rods are semi-molten to provide a common rigid structure.

24. The method according to claim 23 including forming said insulating rods of glass.

25. The method according to claim 23 including providing ones of said structures as metal wafers, portions of said wafers being embedded in said rods.

26. The method according to claim 23 including rigidly supporting said common structure within a glass envelope.

27. A traveling wave tube comprising:

an electron gun structure, a slow wave structure through which an electron beam provided by said electron gun structure passes, and a collector structure;

an envelope enclosing said structures, said envelope being formed of insulating material and provided with a plurality of rods also formed of insulating material and supported inside said envelope, said rods in turn rigidly supporting said electron gun structure, said slow wave structure, and said collector structure, and means for coupling an r.f. signal input to and receiving an r.f. signal output from said slow wave structure.

28. A traveling wave tube comprising:

an electron gun structure and a slow wave structure through which an electron beam provided by said electron gun structure passes, and a collector structure, an envelope enclosing said structures, said envelope being formed of insulating material and provided with a plurality of rods also formed of insulating material and supported in said envelope, said rods in turn rigidly supporting said electron gun structure and said slow wave structure, and means for coupling an r.f. signal input to and receiving an r.f. signal output from said slow wave structure, wherein said collector structure comprises a plurality of spaced conducting wafers apertured to receive said electron beam and supported by said rods, said wafers being maintained at successively lower voltage levels along said beam.

29. A traveling wave tube comprising:

an electron gun structure and a slow wave structure through which an electron beam provided by said electron gun structure passes, said slow wave structure comprising a plurality of metal wafers disposed along the path of said electron beam, said wafers being centrally apertured to pass said electron beam, and insulating rods supporting said wafers, successive wafers along the path of said electron beam being insulated from one another and receiving different voltages for focussing said electron beam, wherein successive wafers are spaced from one another along said path of said electron beam to form electromagnetic cavities, at least ones of said wafers also having apertures spaced radially from the path of said electron beam to provide coupling between cavities to supply a path through which electromagnetic energy is propagated.

30. A traveling wave tube comprising:

an electron gun structure, a slow wave structure through which an electron beam provided by said electron gun structure passes, and a collector structure, an envelope enclosing said structures, said envelope being formed of insulating material and provided with a plurality of rods also formed of insulating material and supported in said envelope, said rods in turn rigidly supporting said electron gun structure and said slow wave structure, and means for coupling an r.f. signal input to and receiving an r.f. signal output from said slow wave structure, wherein said slow wave structure provides electrostatic focussing of said electron beam as well as amplification of the r.f. signal by interaction with said electron beams, and wherein said slow wave structure comprises a coupled cavity stack having voltage applied thereto for producing said focussing of said beam, said slow wave structure providing amplification of r.f. energy, said cavity stack comprising at least several apertured wafers having apertures thereof lined to receive said electron beam while also being insulated from one another, the cavities of said cavity stack being formed between successive wafers, said wafers being provided with additional apertures for r.f. coupling between cavities.

* * * * *